United States Patent [19]

Johnson et al.

[11] Patent Number: 4,664,465

[45] Date of Patent: May 12, 1987

[54] CLIP DEVICE

[75] Inventors: George E. Johnson, Bronxville; Walter Newman, Forest Hills, both of N.Y.

[73] Assignee: Leviton Manufacturing Company, Inc., Little Neck, N.Y.

[21] Appl. No.: 890,249

[22] Filed: Jul. 28, 1986

Related U.S. Application Data

[63] Continuation of Ser. No. 794,037, Nov. 1, 1985, abandoned, which is a continuation of Ser. No. 732,038, Apr. 29, 1985, abandoned, which is a continuation of Ser. No. 484,048, Apr. 11, 1983, abandoned.

[51] Int. Cl.[4] ..... H01R 13/46

[52] U.S. Cl. ..... 339/119 L; 339/25; 339/125 L; 81/125; 81/461; 411/527

[58] Field of Search ..... 339/25, 119 L, 125 L, 339/154 L; 411/525-528; 81/90 R, 90 C, 119, 121 A, 121.1, 125, 461

[56] References Cited

U.S. PATENT DOCUMENTS

| | | | |
|---|---|---|---|
| 1,485,614 | 3/1924 | Janovsky | 339/25 X |
| 2,387,251 | 10/1945 | Eggert et al. | 411/526 |
| 3,182,939 | 5/1965 | Seckerson | 411/526 X |
| 3,621,234 | 11/1971 | Fremont | 339/119 L |
| 3,648,549 | 3/1972 | Siddall | 81/90 C |

*Primary Examiner*—Gil Weidenfeld
*Assistant Examiner*—Steven C. Bishop
*Attorney, Agent, or Firm*—Paul J. Sutton

[57] ABSTRACT

The present invention provides a device for mounting a lamp socket, particularly for a candelabrum lamp having an elongated branch support having a passage for passing wires between the socket and an electrical source. The elongated support has a threaded end portion with an opening leading to the passage. A clip member having a vertical pocket and a horizontal wall forming an aperture for receiving the threaded portion of the support and a pair of opposed clip elements having opposed arcuate edges is pressed upon or screwed around the threaded portion via the clip elements. A bar connected to the socket has a free mounting end that is adapted to slide into the vertical pocket of the clip member. The socket is removable from the clip. The clip can be pressed or screwed onto the threaded portion by a mounting tool. Likewise, the clip can be unscrewed from the threaded member by the mounting tool.

5 Claims, 10 Drawing Figures

FIG. 3
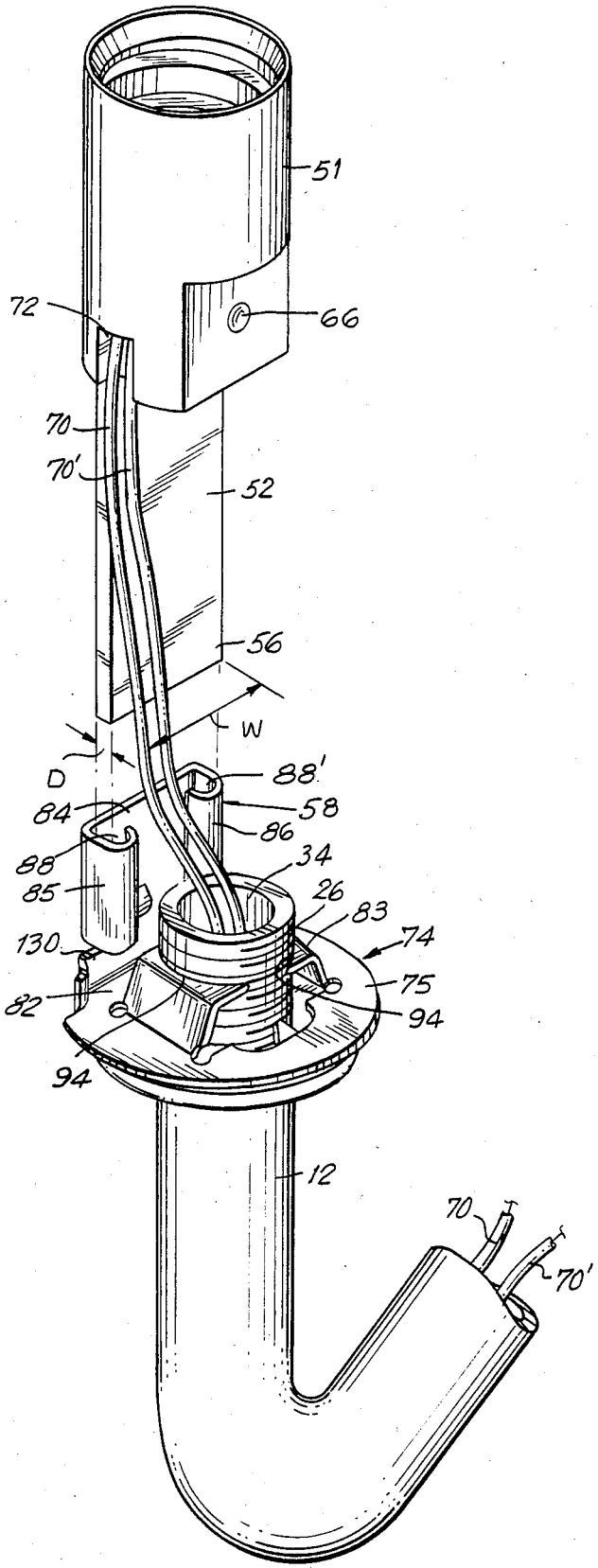
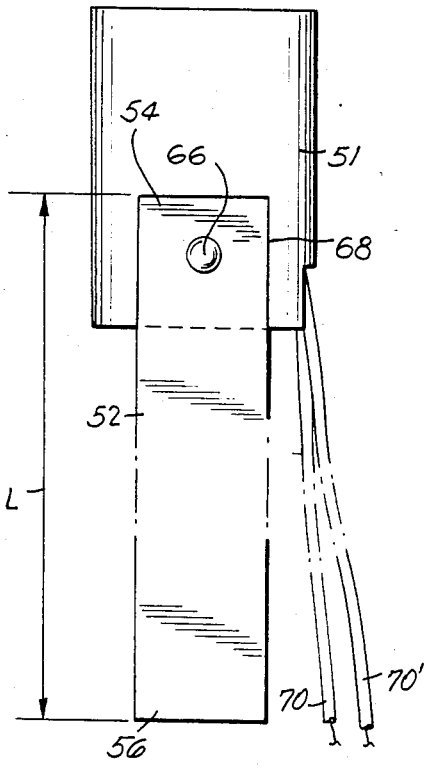
FIG. 4

FIG. 9
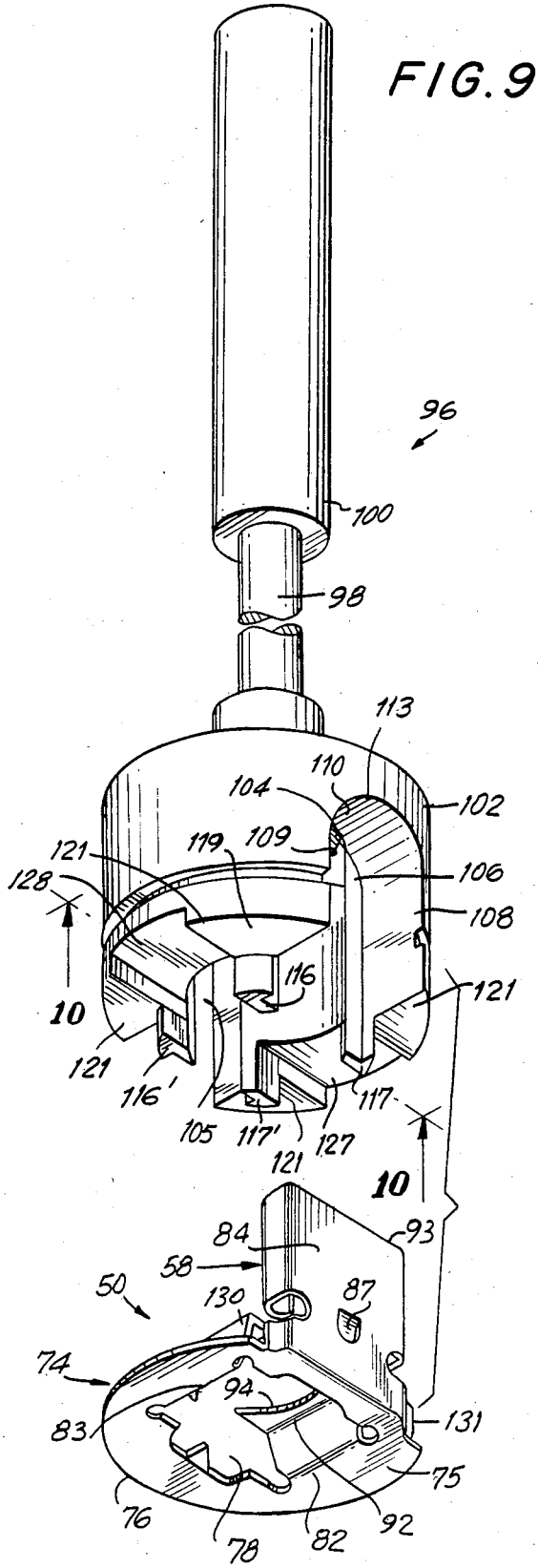
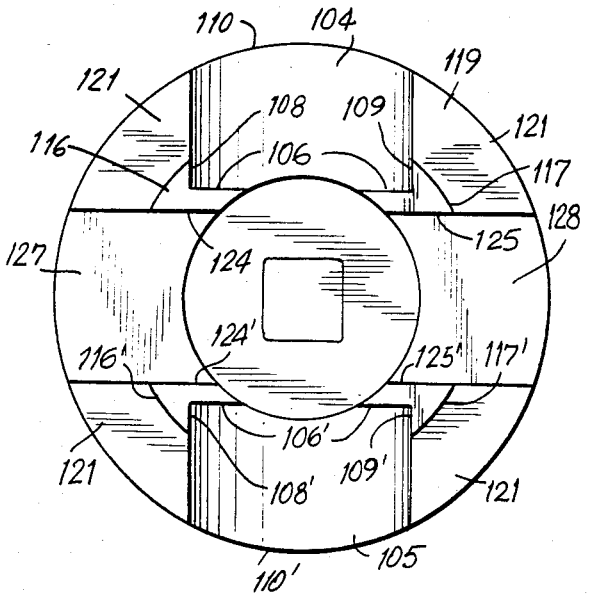
FIG. 10

CLIP DEVICE

This application is a continuation of application Ser. No. 794,037, filed Nov. 1, 1985, now abandoned, which ia a continuation of application Ser. No. 732,038, filed Apr. 29, 1985, now abandoned, which is a continuation of application Ser. No. 484,048 filed Apr. 11, 1983, now abandoned.

This application relates generally to devices for attaching a lamp socket to a support tube for the socket that has a passage for passing the electrical wires from the socket to an electrical source. In particular, the present invention relates to devices for mounting a lamp socket of a candelabrum type lamp to one of the support branches of the candelabrum.

Present lamp sockets for candelabrum type lamps are provided with a mounting bar connected to the side of the socket and that has a transverse flange having internal threads for receiving the external threads of the end of the elongated support that mounts the lamp either to a wall or the stem of the candelabrum. The elongated support member is hollow and curved in various shapes for aesthetic purposes. The paired connecting wires from the socket extend from their contacts in the socket through the member or branch nember for electrical connection to an electrical source. If both the wires and the socket are being replaced, or just the wires, the procedure is first to force the paired connecting wires through the hollow portion of the branch support and then to rotate the socket onto the threaded portion of the hollow branch support via the flange of the mounting bar. When the socket is being rotated, the paired wires are likewise being rotated. Therefore to avoid having broken insulation on the wires and a resulting short, the wires extending from the opposite end of the mounting bar must likewise be rotated in the opposite direction. This is an uncertain and burdensome procedure. Also, in the event old wires are kept in the branch and connected to a new socket which is then rotated, untwisting the wires is uncertain since the original position of the wires cannot be determined. Curved, even at times convoluted, configurations of the branches of a candelabrum make untwisting a connecting wire held in the often narrow confines of the passage of the branch holder additionally difficult.

Accordingly, it is an object of the present invention to provide a device that enables a lamp socket to be mounted to a conduit branch for a candelabrum without rotating the lamp socket and the connecting wires.

It is another object of the present invention to provide a clip device that can be removably positioned around the threaded portion of a candelabrum conduit branch that is capable of receiving a support bar connected to a lamp socket so that the lamp socket can be mounted to the threaded portion directly without the necessity of rotating the lamp socket.

It is yet a further object of the present invention to provide a clip device that can be pressed over the threaded end portion of a candelabrum branch by means of a mounting tool, the device being able to mount a lamp socket without rotating the socket.

It is still another object of the present invention to provide a device that is adapted to be pressed over the threaded end portion of a candelabrum branch, or alternatively, to be screwed on the threaded end portion and in addition to be unscrewed from the threaded end portion by means of a mounting tool, the device being adapted to receive a mounting bar connected to a lamp socket thus mounting the socket to the device without having to rotate the socket and the electrical connectors.

It is yet a further object of this invention to provide a lamp socket having a flat mounting bar connected to a lamp socket at one end and having an opposed mounting end adapted to be slid into a pocket portion of a clip device that is clipped onto the threaded end portion of a conduit branch holder of a candelabrum.

The novel means employed to overcome the disadvantages of the prior art that create the problems to be overcome by the present invention include a device for mounting a lamp socket comprising an elongated support member forming an elongated passage. The support member, which is a branch support of a candelabrum, has an externally threaded portion at one end, which has an opening to the passage. A circumferential flange closely spaced from the inner end of the threaded portion provides support for a glass globe that is set into a globe receptacle that in turn is set around the threaded portion and rests upon a support ring set upon the circumferential flange around the threaded portion. A socket, which holds a lamp bulb, has one end of a mounting bar secured to it. A clip is removably secured to the threaded portion, the clip being adapted to removably engage the free end of the mounting bar, thus securing the socket to the support member. Paired electrical connectors are connected to the electrical contacts in the socket and extend from the socket through the opening to the passage and through the passage and the support branch to electrical contacts.

The clip includes a pocket portion and a base portion. The base portion includes a substantially flat base wall which forms a central aperture adapted to receive the threaded portion of the support member. The base portion has a pair of opposed biased clip elements extending from the base wall over a part of the aperture. The clip elements engage the threads of the threaded portion. The pocket portion is adapted to receive the free, or mounting, end of the bar member. The pocket portion of the clip member includes a vertical wall secured to the periphery of the base portion. The vertical wall is substantially perpendicular to the base portion and is located substantially midway between the opposed biased clip elements. The vertical wall has opposed vertical edge portions and opposed C-shaped channel members forming cpposed vertical slots extending over the base portion. The mounting end of the mounting bar member is disposed in the slots. The clip elements have opposed arcuate inner edges configured to engage the threads of the threaded portion, so that the clip device can be alternately pressed on or screwed on or off the threaded portion. A mounting tool is adapted to receive the clip member in removable engagement. When mounted to the tool, the tool can be used to press the clip device over the threads of the threaded portion of the branch support until the clip device comes to rest against the bottom wall of the globe receptacle, the well in turn resting against the mounting ring, which sets immediately on the circumferential flange just below the threaded portion.

The invention will be more clearly understood from the following description of a specific embodiment of the invention, together with the accompanying drawings, wherein similar reference character denote similar elements throughout the several views, and in which:

FIG. 3 is a perspective, partially exploded view of the invention in isolation.

FIG. 4 is a rear view of the socket and mounting bar.

FIG. 9 is an exploded perspective view of the mounting tool and the clip member.

FIG. 10 is a frontal view of the body of the mounting tool taken through line 10—10 of FIG. 9.

Reference is now nade in detail to the drawings.

In the detailed description which follows below, certain references are made to vertical and horizontal alignments in accordance with the positions of the elements on the drawings. It is apparent that a lamp may at times not be upright and relative horizontal alignments may then tilt from the level. But for the sake of convenience, such terms as "vertical," "horizontal," "top," and so on are used where such terms would be generally understood from the alignment of the embodiment in the several figures.

Figure 1:
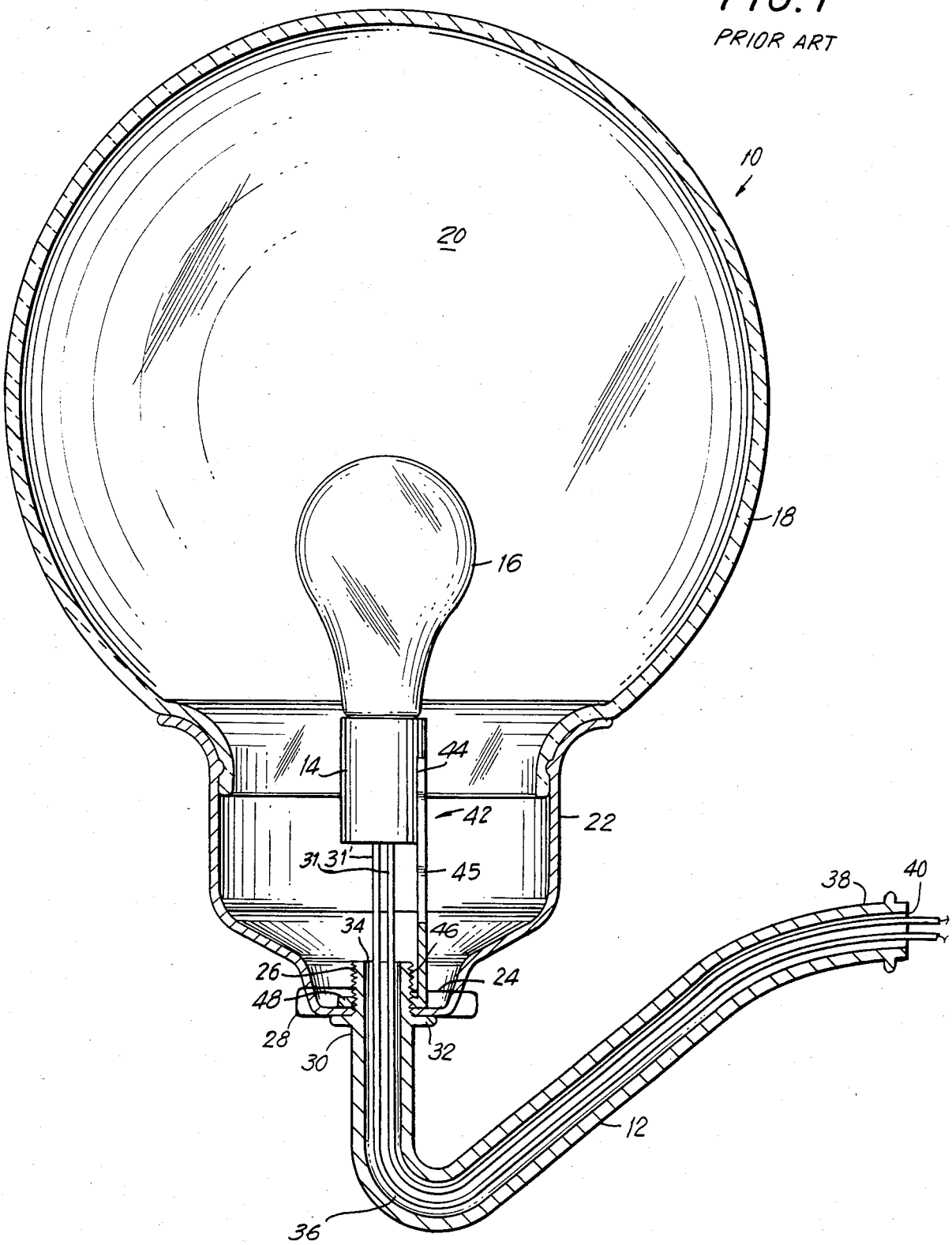
FIG. 1 PRIOR ART
FIG. 1 is a partial sectional elevational side view of a prior art embodiment related to the present invention.

A partially sectional elevational view of a prior art embodiment to which the present invention is related is shown in FIG. 1. As illustrated in FIG. 1, a lamp having an elongated support 12 either alone or one branch of a candelabrum supports a socket member 14 holding a light bulb 16 which is screwed into its socket. A surrounding glass globe 18 is set at its base into the chamber 20 of a globe support receptacle 22. The base, or well, 24 in the globe receptacle 22 in turn is set around an upright externally threaded portion 26 of the elongated member 12 and specifically is in contact with a mounting ring 28 likewise set around the end 30 of support member 12 at the threaded portion 26. Mounting base ring 28 is set upon a circumferential ring flange 32 extending outwardly from support member 12 spaced below end 30 adjacent to threaded portion 26. A pair of electrical wire conductors 31 are connected to electrical contacts in socket 14 in a known manner and extend to an opening 34 at end 30 which leads to elongated passage 36 formed in elongated support member 12 through to the opposite end 38 and through opposite opening 40 to electrical connectors in the candelabrum, in the wall, or in whatever body to which support member 12 is connected.

FIG. 1 illustrates the prior art mounting of socket 14 upon threaded portion 26. In particular, a mounting bar 42, preferably of metal and substantially flat, has a vertical portion 45 and a horizontal portion 48 extending from said vertical portion. Vertical portion 45 has an upper edge 44 secured to socket 14 and horizontal portion 48 is screwed onto threaded portion 26 by way of vertical threaded aperture 46 formed in horizontal portion 48.

Thus, in the prior art, when a new socket or new wires are to be placed in the lamp, after removal of globe 18, the new wires are slid through opening 34 through passage 36 and thereupon mounting bar 42 is screwed upon threaded portion 26 at aperture 46 of horizontal portion 48. At this time, it is seen that a problem ensues, namely, that as socket 14, to which the pair of wire connectors 31 are connected, is rotated in the screwing operation, the wire connectors 31 are likewise rotated and begin to twist in passage 36. The twisting can result in a breaking of the wires. So, as socket 14 is rotated, wire conductors 31 must be continuously untwisted at far opposite end 38 where the wires extend from opposite opening 40.

Figure 2:
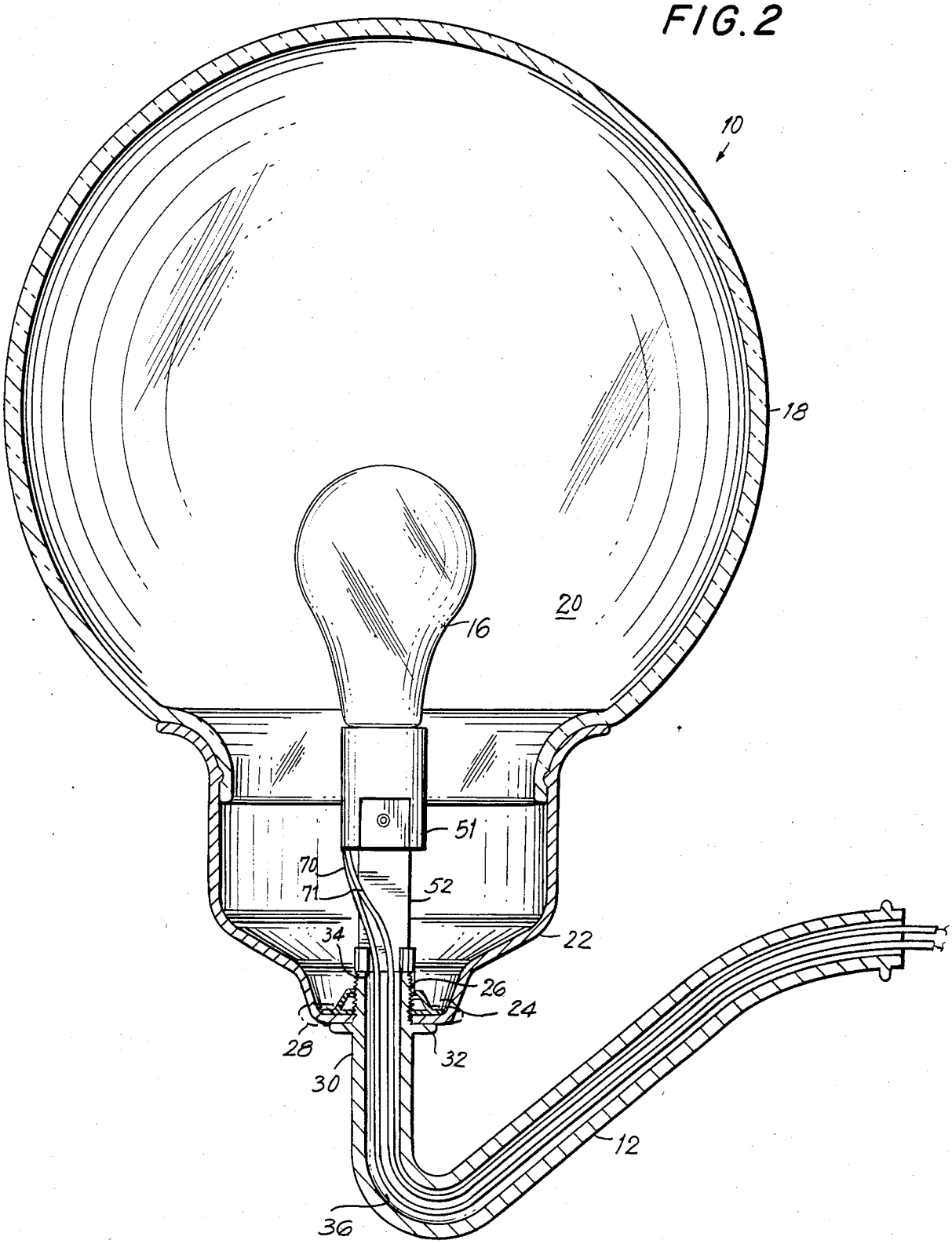
FIG. 2 is a partial sectional elevational front view of the invention.
Figure 6:
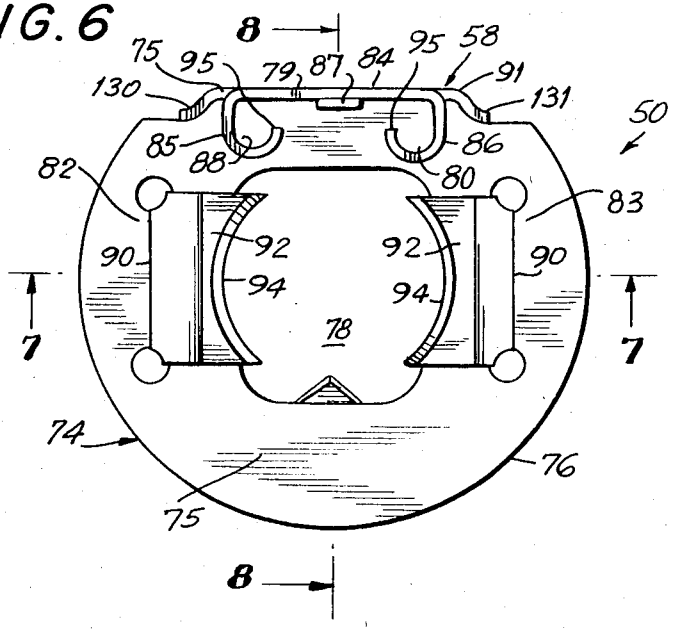
FIG. 6 is a top view of the clip member.
Figure 8:
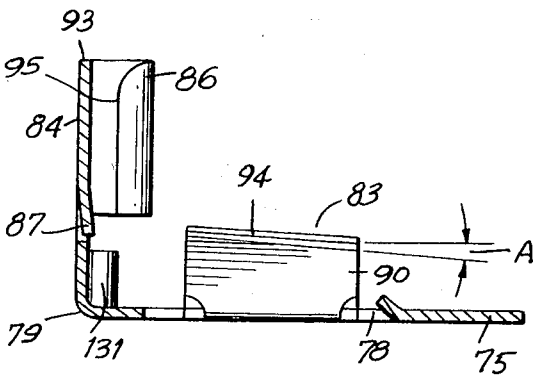
FIG. 8 is a view taken through line 2—2 of FIG. 6.
Figure 5:
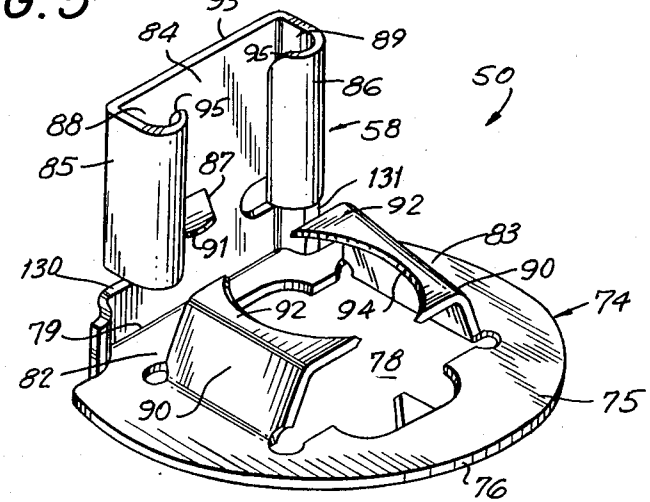
FIG. 5 is a perspective view of the clip member.

In accordance with the present invention, a clip member 50 is shown in mounted position in frontal elevation in FIG. 2 and in exploded perspective in FIG. 3. In FIG. 2, light bulbs 16, globe 18, globe receptacle 20, and ring base 24 are shown in phantom lines so as to emphasize the inventive aspects of the present invention. FIG. 3 shows clip member 50 set around threaded portion 26 with light bulb 16, globe 18, globe receptacle 20, and ring base 24 removed, again for the purpose of concentrating upon the inventive features of the present invention.

Socket member 51 is here provided with a mounting bar 52 that has an upper connecting end 54 secured to socket 51. The opposed, or mounting end, 56 is slidingly received by pocket portion 58 of clip member 50, as will be explained in detail below. Mcunting bar 52 preferably is an elongated substantially flat rectangular prism having a length L, a width W, and a depth D, the depth being, as mentioned of small dimension. Ends 54 and 56 are at opposite ends of the length 60, with end 54 being secured to socket 51 by way of through rivet 66, which can be seen both in front view in FIGS. 2 and 3 as it extends through socket 14 and in rear view in FIG. 4, where the rivet is seen set against bar 52. Upper end 54 of bar 52 is inset into socket 51 in the same manner as upper end 44 of mounting bar 42 to socket 14 as indicated in FIG. 1 so that the outer wall 68 of socket 51 is flush with the outer face of mounting bar 52.

A pair of electrical connecting wires 70 and 70′ are secured to socket member 51. The leads of wires 70 and 70′ are secured to electrical contacts within socket 51 in a known manner and exit from the socket 51 from a socket recess 72 formed at the bottom and side of the socket as best seen in FIG. 3. Wires 70 and 70′ extend alongside mounting bar 52 to opening 34 of threaded portion 26 of support member 12 and through passage 36 and through opposite opening 40 and on to be secured to electrical conductor leads (not shown) of a power source.

In order to avoid the necessity of twisting socket 51 and along with it socket wire conductors 70 and 70′ in passage 36, and in accordance with the present invention, a clip member 50 is adjustably set around threaded portion 26. Clip member 50, shown in FIGS. 3, 5, 6, 7, and 8, includes a substantially flat base portion 74 including substantially flat base wall 75 having a preferably circular portion 76 and linear portion 79. Base wall 75 forms a central aperture 78 adapted to receive threaded portion 26. Clip member 50 also includes a pocket portion 58 adapted to slidingly and removably receive mounting end 56 of mounting bar 52. Base portion 74 includes a pair of opposed biased clip elements 82 and 83 extending inwardly over a portion of aperture 78. Clip elements 82 and 83 are adapted to slidingly engage with threaded portion 26. In particular, pocket portion 58 includes an upright wall 84 extending substantially perpendicular to base wall 75 at the linear portion 79 of partially circular periphery 76. Wall 84 is connected to base wall 75 so as not to extend beyond an imaginary circumference if partially circular periphery 76 were extended, specifically wall 84 is secured to linear portion 79 of base wall 75. It is to be understood that base portion 74 is preferably partially circular and is contained within an imaginary circular periphery in order to be firmly seated against the wall 24 of globe support receptacle 22 which forms a recess with a flat circular bottom. The exact diameter and configuration of base portion 74 can vary according to requirements. Wall 84 is positioned approximately midway between opposed clip elements 82. Wall 84 has opposed vertical edge portions 95 in turn having a pair of opposed preferably C-shaped channel members 85 and 86 that a viewed in cross-section form a pair of opposed vertical slots 88 and 88' adapted to receive the sides of the width W of mounting bar 52. Slots 88 and 88' are formed in part by wall 84 and the the opposing wings of C-shaped channel members 85 and 86 so that the width W of bar 52 is gripped slightly by slots 88 and 88'. It is of course not necessary that opposed channel members 85 and 86 be C-shaped, for they could be rectangular, for example. But the preferred C-shaped configuration is advantageous since the vertical edges as of the C-shaped portions are preferably curled slightly inwards towards wall 84, the vertical edges being positioned so as to press bar 52 tightly against opposed wall 84.

Figure 7:
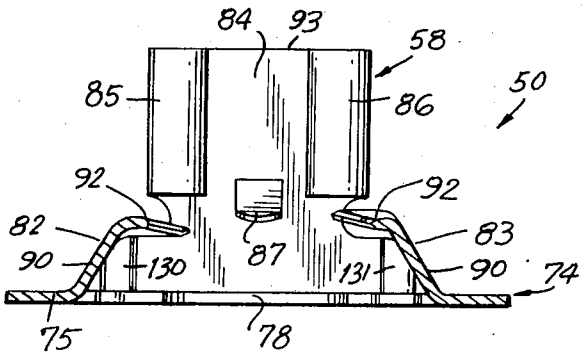
FIG. 7 is a view taken through line 1—1 of FIG. 6.

The biased clip elements 82 as shown in FIGS. 3 and 7 have opposed first portions 90 that extend upwardly from base 74 at a slight angle over aperture 78 and second portions 92 that extend close to the horizontal(-but preferably not exactly at the horizontal as will be explained) over a part of aperture 78. The second portions 92 of clip elements 82 have opposed arcuate inner edges 94 that are configured to engage the threads of threaded portion 26; edges 94 form a partial circle having a diameter. The thickness of second portions 92 at arcuate inner edges 94 are of the thickness to fit into the thread recesses of threaded portion 26. Clip elements 82 are slightly biased so that they can be snapped over the top of threaded portion 26 and flexibly retreat from the outer rim of the threads of threaded portion 26 and then ar self-biased back into engagement into the inter-rib spaces. Thus biased clip elements 82 resist removal or movement upward relative to threaded portion 26.

Second portion 92 of clip elements 82 preferably tilt at a slight angle A from the plane of base 74 downwards from wall 84 so that arcuate inner edges 94 conform to the angle of the ribs of the threads of threaded portion 26.

Angle A would vary according to the diameter of threaded portion 26 and the resultant angle of the ribs of the threads. Thus, arcuate inner edges 94 makes it possible that clip device 50 can be screwed onto threaded portion 26 and likewise screwed off of threaded portion 26. Alternatively, clip device 50 can be pressed onto threaded portion 26 and can be screwed from threaded portion 26. In addition, as can be seen in FIG. 7, clip elements 82 and 83 are specially contoured and arranged so that the arcuate inner edges 94 of each are in alignment with the spiraled recesses of the threads of threaded portion 26. As illustrated, second portion 92 of clip element 82 is configured, or directed, slightly downwards towards base wall 75, while second portion 92 of clip element 83 is directed slightly upwards away from base wall 75. This is a preferred construction and arrangement, and of course either clip 82 or 83 could be molded somewhat differently for the same result.

Wall 84 includes a bias element 87 integral with, that is, cut from, the center portion of the wall. Bias element 87 includes an upper portion 89 and a lower portion 91, lower portion 91 being spaced from base 74 and top portion 89 being spaced from top edge 93 of wall 84. Upper portion 89 is connected to wall 84 and lower portion 91 extends inwardly from wall 84 towards aperture 78. Bottom portion 91 biasedly presses against mounting end 56 of bar 52 so that bar 52 is pressed against vertical edges 95 of C-shaped wall portions 85 and 86 that turn inward toward vertical wall 84. In addition, the projecting bottom edge of bottom portion 91 inhibit bar 52 from sliding from the pocket during manipulation of the lamp.

In accordance with the present invention, clip 50 can be pressed over threaded portion 26 of support member 12, or alternatlvely, be screwed onto threaded portion 26 by means of mounting tool 96, which is shown in perspective in FIG. 9. As illustrated, a rod 98 has a handle 100 at one end and a mounting body 102, preferably made of cast metal, is connected to the other end. Body 102 is configured to receive clip device 50 in removable engagement so that clip device 50 can be slid onto body 102 and then, by maneuvering clip 50 over threaded portion 26, biased clip elements 82 will resiliently pass over the ribs of threaded portion 26 as the tool 96 is pressed towards base 24 of globe support receptacle 22. When clip device 50 is positioned to its maximum distance onto threaded portion 26 and is set against base 24, the tool can be withdrawn, and, because the biased clip elements 82 engage the ribs of threaded portion 26, clip member 50 remains in position around threaded portion 26 and tool 96 can be withdrawn so that clip member 50 slides out of body 102 of the tool. Alternatively, tool 96 can be used to position the arcuate inner edges 94 of biased clip elements 82 and 83 into threadable engagement with the threads of threaded portion 26 and thereupon rotated so as to screw clip member 50 onto threaded portion 50 until the clip member 50 is seated against base 24. In a reversal of this process, body 102 can be slid onto clip member 50 when it is in a seated position against base 24, tool 96 can then be rotated, thus rotating clip member 50 via arcuate inner edges 94, which are in threadable connection with the threads of threaded portion, from base 24 and complete removal of clip member 50 from threaded portion 26.

In accordance with the present invention body 102, which is preferably basically cylindrical in configuration so as to be generally coextensive with partially circular periphery portion 76 of clip member 50, forms two opposed pocket recesses 104 and 105, each of which are adapted to receive pocket portion 58 of clip device 50. In fact, only one pocket recess is needed, but the two pocket recesses illustrated in the embodiment of FIGS. 9 and 10 are preferred as adding convenience to the user. Each pocket recess, 04 and 105, has a rear wall 106 opposed side walls 108 and 109, and 108' and 109', and an open side 110 and 110' opposite rear wall 106 and an open top. Rear wall 106 is substantially perpendicular to side walls 108 and 109 and all three walls, 106, 108 and 109 are substantially parallel to rod 98. Recess bottom 113 is shown as curved in FIG. 9, but can be of any configuration since the bottom extends deeper into body 102 than top edge 93 of wall 84 extends into body 102 when clip member 50 is set into either pocket recess. A pair of support element or pieces, 116 and 117 extend outwardly from end face 119 of body 102, which is opposite rod 98 and substantially perpendicular to the rod. Pieces 116 and 117 are positioned at the corners of rear wall 106 and side wall 108 and create short extensions of those walls beyond face 119. FIG. 10 looks directly at face 119, which in fact is constituted by four corner plateaus 119 that adjoin support pieces 117 and 118 and, in addition, adjoin two other similar support pieces, 116' and 117', which likewise extend outwardly from face 119 and form a part of pocket recess 105 in the same manner as pieces 116 and 117 form a part of pocket recess 104. Rear wall 106 receives the outer surfaces of C-shaped wall portions 85 and 86 in sliding engagement and side walls 108 and 109 receive the side surfaces of C-Shaped wali portions 85 and 86 in sliding engagement. Support pieces 116 and 117 each have inner walls 124 and 125 closely spaced from rear wall 106. Inner walls 124 and 125 are adapted to receive the inner edges (or the outer edges according into which pocket recess pocket portion 58 is inserted) of biased clip elements 82 and 83. Likewise, support pieces 116' and 117' each have inner walls 124' and 125' closely spaced from rear wall 106' of pocket recess 105' adapted to receive either the inner edges(or the outer edges) of biased clip elements 82 and 83. A pair of clip element recesses 127 and 128 are formed between outwardly extending support pieces 116 and 116' and 117 and 117' respectively. When clip device 50 is pressed into body 102, and pocket portion slides into either pocket recess 104 or 105, movement ceases when the top ends of support piece 116, 117, 116' and 117' come into contact with the inner surface of base portion 74, since the top ends lie substantially in the same plane which is substantially perpendicular to rod 98.

In order that the mounting of clip device 50 onto body 102 be more secure, a pair of flanges 130 and 131 extend outwardly from vertical edge portion 95 of vertical wall 84 of pocket portion 58. Flanges 130 and 131 are spaced from clip elements 82 and 83 and is integral with base wall 75 specifically at linear portion 79. Flanges 130 and 131 are adapted to engage each of the pair of support elements 116 and 117(or 116' and 117', as the case may be) when clip device 50 is mounted onto body 102. Thus, each of the pair of projecting elements 116 and 117 is wedged between one of the flanges 130 or 131 and one of the clip elements 82 and 83. Specifically, projecting element 116 is wedged between clip element 82 and flange 130; and projecting element 117 is wedged between clip element 83 and flange 131. Alternatively, projecting element 116' is wedged between clip element 83 and flange 130; and projecting element 117' is wedged between clip element 82 and flange 131.

The embodiment of the invention particularly disclosed and described herein is presented merely as an example of the invention. Other embodiments, forms, and modifications of the invention comprising within the proper scope and spirit of the appended claims will, of course, readily suggest themselves to those skilled in the art.

What is claimed is:

1. A device for mounting a light bulb onto an elongated support member of a lamp fixture, the elongated support having an externally threaded portion at one end thereof, forming an opening to the passage, said device comprising:

a lamp socket adapted to mount the light bulb, a mounting bar member secured to said socket at one end, said bar member having an opposed mounting end, clip means for removably securing onto the externally threaded portion of the elongated support member, said clip means removably engaging said mounting end of said bar and securing said socket to the support member, said clip means comprising a pocket portion and a base portion, said base portion including a substantially flat base wall forming a central aperture adapted to receive the threaded portion of the support member, said base portion having a pair of opposed upwardly directed, inwardly biased, flexible cantilevered clip elements freely extending from said base wall over a part of said aperture, said clip elements having opposed arcuate inner edges configured to engage the threads of the threaded portion, said arcuate inner edges of said clip elements respectively lying in opposing angularly crossing planes angled to the plane of the base of said wall, said angle being substantially the same angle as the thread angle of the threaded portion, whereby said clip means can be selectively screwed on or off the threaded portion as well as pressed over the threaded portion with said biased elements locking said clip means onto the threaded portion, said pocket portion being adapted to receive said mounting end of said bar member, a pair of electrical wires connected to electrical contacts in said lamp socket, said wires extending from said socket for insertion in the opening and into the elongated passage of the support member, and mounting tool means for detachably holding said clip means and selectively pressing, threading or unthreading said clip means onto or off of the threaded portion of the elongated support member, said mounting tool means comprising:

a rod having a handle at one end and a mounting body at the other end, said body having an end face opposite said rod and substantially perpendicular to said rod, and two pairs of projecting elements outwardly from said face, said body including a pocket recess adapted to receive said pocket portion of said clip means in removable sliding engagement, and clip recesses adapted to receive said clip elements in removable sliding engagement, said two pairs of projecting elements having ends lying in a plane substantially perpendicular to said rod, said ends being in pressing contact with the base wall of said base portion of said clip means when said clip means is in a mounted position on said body, and serving as a stop means for the engagement between said tool means and said clip means, and wherein said clip recesses provide sufficient clearance for the flexing of the clip elements upon pressing of said clip means on to the threaded portion of the elongated support member.

2. A device according to claim 1, wherein said mounting bar member is an elongated substantially flat rectangular prism.

3. A device according to claim 1, wherein said pocket portion of said clip member includes a vertical wall secured to the periphery of said base portion, said vertical wall being substantially perpendicular to said base portion end located substantially midway between said opposed biased clip elements, said vertical wall having opposed vertical edge portions, and opposed C-shaped channel members forming opposed vertical slots, extending over said base portion, said mounting end of said mounting bar member being disposed in said slots.

4. A device according to claim 3, further including a biased element connected to the center portion of said vertical wall, said biased element having an upper portion and a lower portion, said upper portion being integral with said vertical wall and said lower portion extending inwardly from said vertical wall over said base portion said vertical wall forming an aperture coextensive with said lower portion, whereby said biased element presses against said mounting end of said mounting bar in said pocket portion of said clip means.

5. a device according to claim 3, further including a pair of flanges extending outwardly from said vertical wall of said pocket portion, said flanges being spaced from said clip elements and integral with said base wall, said flanges being adapted to engage each of said one pair of projecting elements when said clip means is mounted on said body, whereby said each of said one pair of projecting elements is wedged between one of said flanges and one of said clip elements to thereby hold said clip means.

* * * * *